US011340536B2

(12) United States Patent
Berger et al.

(10) Patent No.: US 11,340,536 B2
(45) Date of Patent: May 24, 2022

(54) ESTABLISHING DISTANCES BETWEEN DEVELOPER ROLLER SURFACES AND ELECTRODES

(71) Applicant: HEWLETT-PACKARD DEVELOPMENT COMPANY, L.P., Spring, TX (US)

(72) Inventors: Shachar Berger, Ness Ziona (IL); Sagie Shanun, Ness Ziona (IL); Roman Katz, Ness Ziona (IL); Shai Rahamim, Ness Ziona (IL); Hay Arbeli, Ness Ziona (IL); Eyal Elbaz, Ness Ziona (IL); Alon Froom, Ness Ziona (IL); Lavi Cohen, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/604,301

(22) PCT Filed: Feb. 14, 2018

(86) PCT No.: PCT/US2018/018193
§ 371 (c)(1),
(2) Date: Oct. 10, 2019

(87) PCT Pub. No.: WO2019/160544
PCT Pub. Date: Aug. 22, 2019

(65) Prior Publication Data

US 2021/0325797 A1 Oct. 21, 2021

(51) Int. Cl.
*G03G 15/06* (2006.01)
*G03G 15/10* (2006.01)

(52) U.S. Cl.
CPC ..... *G03G 15/065* (2013.01); *G03G 15/104* (2013.01)

(58) Field of Classification Search
CPC .... G03G 15/10; G03G 15/065; G03G 15/104; G03G 2215/0643; G03G 2215/0647; G03G 2215/0658
See application file for complete search history.

(56) References Cited

U.S. PATENT DOCUMENTS 4,396,927 A 8/1983 Amaya et al.
6,109,730 A 8/2000 Nilsson et al.
(Continued)

FOREIGN PATENT DOCUMENTS

EP 0710897 A1 5/1996
JP 0643762 A 2/1994
WO WO-2017074360 A1 5/2017

*Primary Examiner* — Thomas S Giampaolo, II
(74) *Attorney, Agent, or Firm* — HP Inc. Patent Department

(57) ABSTRACT

In one example of the disclosure, a developer system includes a housing and a developer roller. A first electrode and a second electrode are disposed in the housing, the first and second electrodes to create an electrical charge to cause transfer of printing fluid to a developer roller surface. The developer roller is rotatably connected to the housing. The developer includes a surface, a bearing to support and enable rotation of an axle attached to the developer roller, and a plurality of stop pins. The plurality of stop pins are connected to the housing. The stop pins are to support the bearings and to establish target distances between the developer roller surface and the first electrode and second electrodes.

13 Claims, 8 Drawing Sheets

(56) References Cited

U.S. PATENT DOCUMENTS

| | | | | |
|---|---|---|---|---|
| 6,231,164 | B1 | 5/2001 | Shibata et al. | |
| 7,792,444 | B2 | 9/2010 | Raz et al. | |
| 8,509,656 | B2 | 8/2013 | Kopp | |
| 8,787,800 | B2 | 7/2014 | Tanner et al. | |
| 2007/0165204 | A1 | 7/2007 | Kibayashi et al. | |
| 2013/0223888 | A1* | 8/2013 | Tanner | G03G 15/10 399/239 |
| 2015/0078785 | A1* | 3/2015 | Tanner | G03G 15/10 399/238 |

* cited by examiner

ESTABLISHING DISTANCES BETWEEN DEVELOPER ROLLER SURFACES AND ELECTRODES

BACKGROUND

A printer may apply print agents to a paper or another print substrate. One example of a printer is a liquid electrophotographic ("LEP") printer, which may be used to print using a fluid print agent such as an electrostatic printing fluid. Such electrostatic printing fluid includes electrostatically charged or chargeable particles (for example, resin or toner particles which may be colorant particles) dispersed or suspended in a carrier fluid).

DRAWINGS

DETAILED DESCRIPTION

Figure 1A:
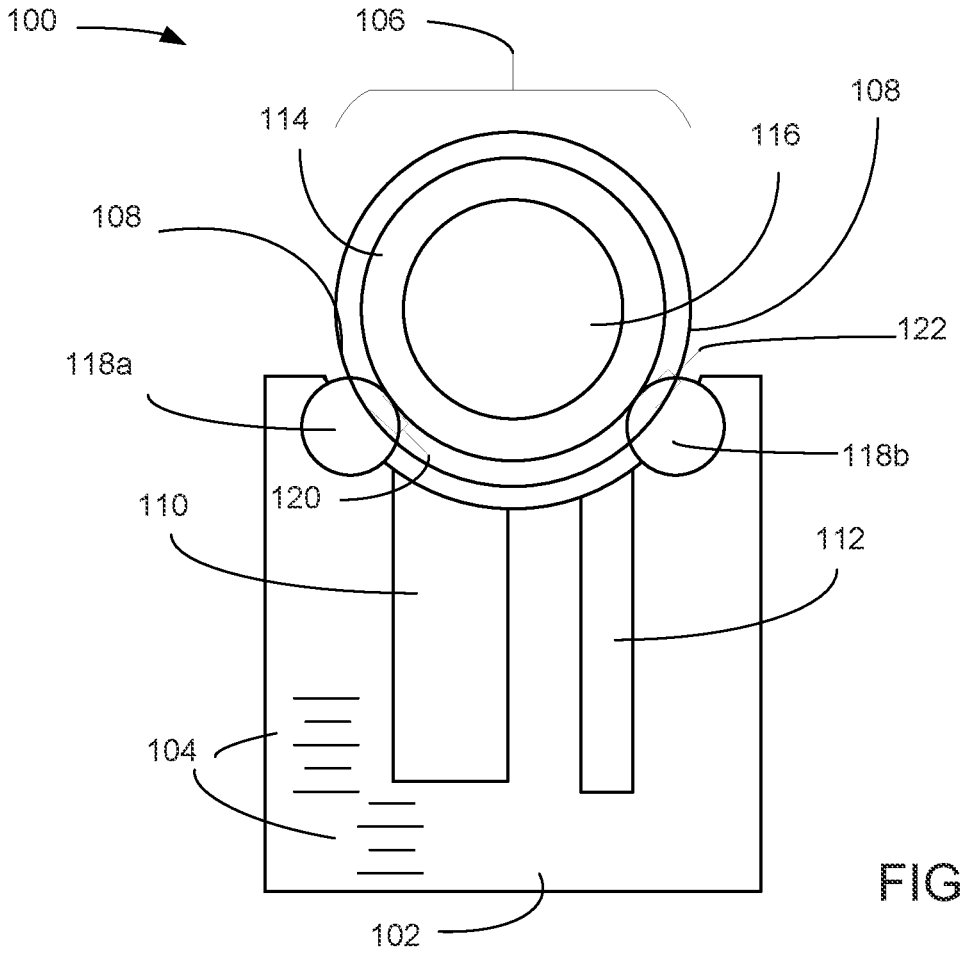
FIG. 1A illustrates an example of a developer system for a LEP printer that includes stop pins for establishing distances between developer roller surfaces and electrodes.

In an example of LEP printing, a printing device may form an image on a print substrate by placing an electrostatic charge on a photo imaging plate ("PIP"), and then utilizing a laser scanning unit to apply an electrostatic pattern of the desired image on the PIP to selectively discharge the PIP. The selective discharging forms a latent electrostatic image on the PIP. The printing device includes a developer system (sometimes referred to as a "developer unit" or a "BID") to develop the latent image into a visible image by applying a thin layer of electrostatic print agent (which may be generally referred to as "LEP print agent", "electronic print agent" or "electronic ink" in some examples) to the patterned PIP. Charged toner particles in the LEP print agent adhere to the electrostatic pattern on the PIP to form a developed image. The developed image, including colorant particles and carrier fluid, is transferred from the PIP to an intermediate transfer member (referred herein as a "blanket"). The blanket is heated until carrier fluid evaporates and colorant particles melt, and a resulting molten film representative of the image is then applied to the surface of the print substrate via pressure and tackiness. For printing with colored print agents, the printing device may include a separate developer system for each of the various colored print agents. There are typically two process methods for transferring a colored image from the PIP to the print substrate. One method is a multi-shot process method in which the process described in the preceding paragraph is repeated a distinct printing separation for each color, and each color is transferred sequentially in distinct passes from the blanket to the print substrate until a full image is achieved. With multi-shot printing, for each separation a molten film (with one color) is applied to the surface of the print substrate. A second method is a one-shot process in which multiple color separations are acquired on the blanket via multiple applications (each with one color) of liquid print agent in from the PIP to the blanket, and then the acquired color separations are transferred in one pass from the blanket to the print substrate.

The development station described above typically includes a set of electrodes to charge the electrostatic print agent, and a development roller to apply the charged print agent to the blanket. The proper electrical development of print agent particles within the developer system is dependent upon having and maintaining an expected gap between the electrodes and the surface of the developer roller. However, setting and maintaining a prescribed gap between the electrodes and the developer roller surface can be challenging as the gap distance can be influenced by variances in one or more of many components that make up the developer system. Any variation in the gap distance, both front to rear and/or back to head, may result in application of a non-uniform layer of print agent upon the blanket, therefore causing print defects on the print substrate.

To address these issues, various examples described in more detail below provide a system and a method that enables establishment of distances between developer roller surfaces and electrodes. In an example, a developer system for use in a LEP printer may include a housing and a developer roller that is to engage with a PIP to cause a transfer of the printing fluid to the PIP. The developer roller is rotatably connected to the housing, and includes a bearing to support and enable rotation of an axle attached to the developer roller, and includes a developer roller surface. The developer system includes first and second first electrodes disposed in the housing, the first and second electrodes to create an electrical charge, e.g., a potential bias, to cause transfer of printing fluid to the developer roller surface. In examples, the first and second electrodes are disposed in the housing such that the electrical charge causes transfer of the printing fluid to the developer roller surface along a neck between the first and second electrodes. The developer system includes a set of stop pins connected to the housing. The stop pins are to support the bearing and are to establish a first target distance between the developer roller surface and the first electrode and a second target distance between the developer roller surface and the second electrode.

In certain examples, the first target distance between the developer roller surface and the first electrode and the second target distance between the developer roller surface and the second electrode are a same distance.

In certain examples, the developer system includes a first bearing and a second bearing, and the set of stop pins includes a first set of stop pins connected to the housing to support the first bearing and to establish a first target distance between the first electrode and the developer roller surface, and includes a second set of stop pins connected to the housing to support the second bearing and to establish a second target distance between the second electrode and the developer roller surface.

In certain examples, the housing includes a first end cap and a second end cap, with each of the first and second electrodes attached to the first end cap, extending through the housing, and also attached to the second end cap. In such examples, the first bearing rests on the first endcap and the first set of stop pins are situated within the first endcap. The second bearing rests on the second endcap and the second set of stop pins are situated within the second endcap.

In certain examples, a set of stop pins includes an eccentric stop pin that is rotatable to a set of predefined positions, e.g., rotatable to a set of predefined positions according to mating holes in an end cap. In other examples, a set of stop pins includes a replaceable stop pin, e.g., a pin selected from a set of pins of different diameters.

In certain examples, the disclosed developer system may include a gap measurement component. The gap measurement component is to receive predicted distance data indicative of a predicted distance between the developer roller surface and the first electrode and a second predicted distance between the developer roller surface and the second electrode. The gap measurement component is to determine an attribute for each of the set of stop pins based upon the first and second predicted distances. In examples, the attribute may be position to which the stop pin has been rotated to influence or set a gap between a developer roller and an electrode. In certain examples, the attribute may be a predefined position for a stop pin according to mating elements in an end cap. In certain examples, the attribute may be a diameter of a stop pin, where the diameter is determined to be advantageous to setting a desired gap between a developer roller surface and an electrode. In certain examples, the gap measurement component is to receive predicted distance data indicative of a set of predicted distances between the developer roller surface and each of the first electrode and second electrode along the length of the developer roller surface, and is to determine the attribute for each of the set of stop pins based upon the set of predicted distances.

In this manner the disclosed developer system and method enables correction of manufacturing and assembly tolerances drift, and enables delivery of developer systems with accurate developer roller surfaces to electrodes gaps. Users of LEP printing systems will appreciate the high print quality made possible by the disclosed system and method for establishing distances between developer roller surfaces and electrodes. Manufacturers of LEP printing systems will enjoy that customer satisfaction is increased and reworking of developer systems is reduced, such that installations and utilization of LEP printers that utilize the disclosed system and method will be enhanced.

FIG. 1A illustrates an example of a developer system 100 for a LEP printer. Developer system 100 includes a housing 102 within which other components are disposed. Developer system 100 includes a developer roller 106 that is rotatably connected to housing 102, the developer roller 106 having a circumferential developer roller surface 108. A first electrode 110 and a second electrode 112 are disposed in housing 102. The first 106 and second 108 electrodes are to create an electrical charge to cause transfer some at least some of printing fluid 104 to a surface 108 of developer roller 106 along a neck of between the first and second electrodes. In this example developer system 100 includes a bearing 114 to support and enable rotation of an axle 116 attached to developer roller 106. System 100 includes a set of stop pins 118*a* 118*b* connected to housing 102. The set of stop pins 118*a* 118*b* are to support the bearing 114 and to establish a first target distance 120 between a surface 108 of the developer roller and first electrode 110, and a second target distance 122 between a surface of the developer roller and second electrode 112.

In the example of FIG. 1A, either of both of stop pins 118*a* and 118*b* may be a non-eccentric or fixed gap stop pin. In an example, either or both of stop pins 118*a* and 118*b* may be a fixed gap, non-eccentric, stop pin that is connected to housing 102. In an example, a fixed gap stop pin may be a replaceable stop pin. In an example, a replaceable stop pin may be a stop pin that has been selected from a set of stop pins and installed because of the diameter of the selected stop pin matches a diameter that has been determined as optimal for establishes a desired target distance between the selected stop pin and an electrode of the developer system.

Figure 1B:
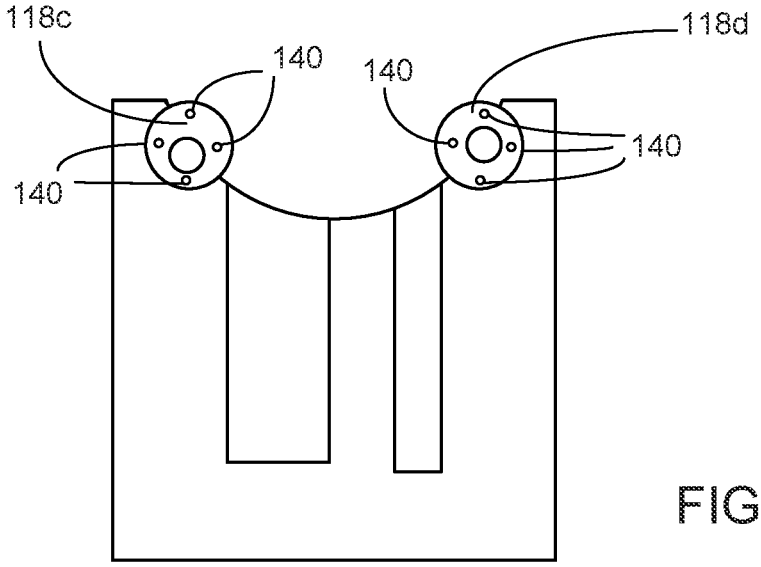
FIG. 1B illustrates an example of a developer system for an LEP printer that includes eccentric stop pins for establishing distances between developer roller surfaces and electrodes.

FIG. 1B illustrates another example of a developer system 100 for a LEP printer that includes one or more eccentric stop pins for establishing distances between developer roller surfaces and electrodes. In this example, a first eccentric stop pin 118*c* and a second eccentric stop pin 118*d* of developer system 100 are round stop pins with axes that are offset relative to the center of the pin. In this manner either or both of the first and second eccentric stop pins can be rotated to a plurality of predefined positions to adjust a gap distance between a developer roller surface 108 (FIG. 1A) and an electrode 110 or 112 (FIG. 1A). In another example, a first eccentric stop pin and a second eccentric stop pin may be stop pins that are not perfectly round, e.g. that are elliptical or oval.

In a particular example, a first eccentric first stop pin 118*c* and a second eccentric stop pin 118*d* are each rotatable to a plurality of predefined positions. In a particular example, the predetermined positions may be defined by mating elements 140 (e.g., holes or knobs) included in housing 102 (e.g. an end cap of housing 102). In yet another example, a first stop pin of developer system 100 may be an eccentric stop pin, wherein a second stop pin a non-eccentric or fixed gap stop pin. In yet another example, a first stop pin may be a non-eccentric or fixed gap pin, while a second stop pin is an eccentric stop pin. In yet another example, none of the stop pins is an eccentric stop pin.

Figure 2A:
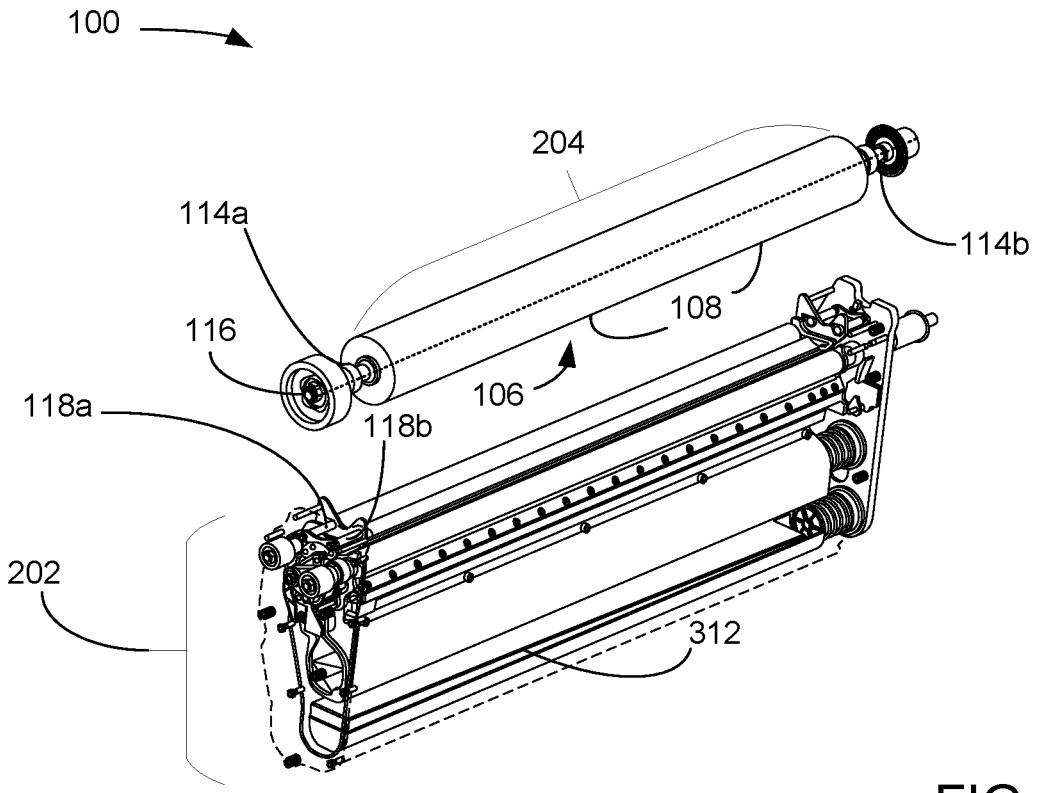
FIG. 2A illustrates a partially exploded view of a developer system for an LEP printer that includes stop pins for establishing distances between developer roller surfaces and electrodes.
Figure 2B:
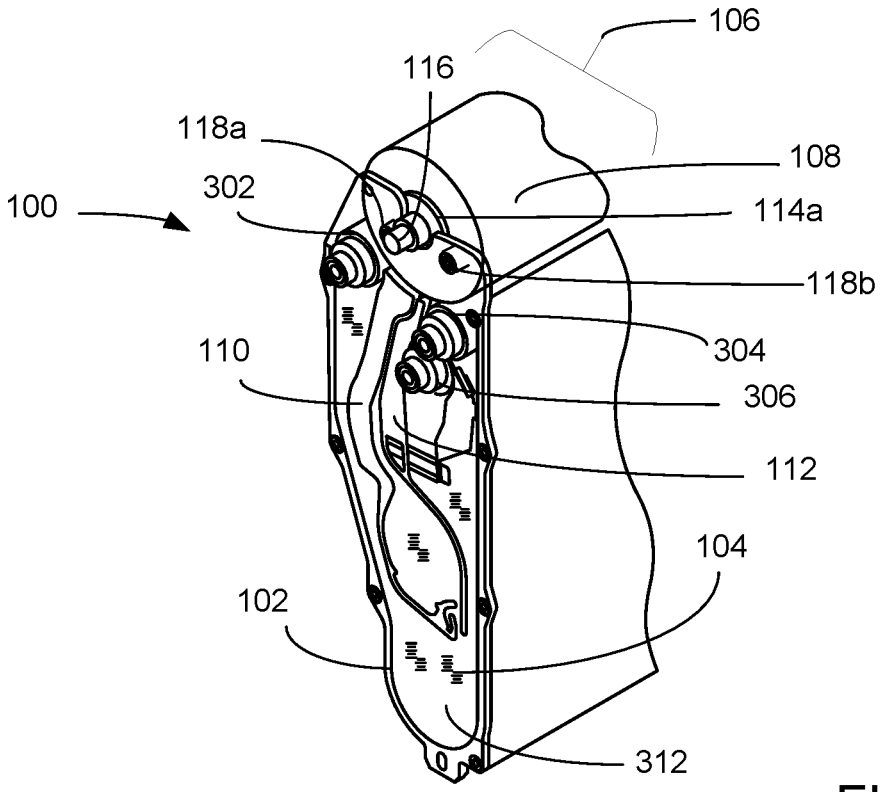
FIG. 2B illustrates a perspective view of the developer system of FIG. 2A.
Figure 3:
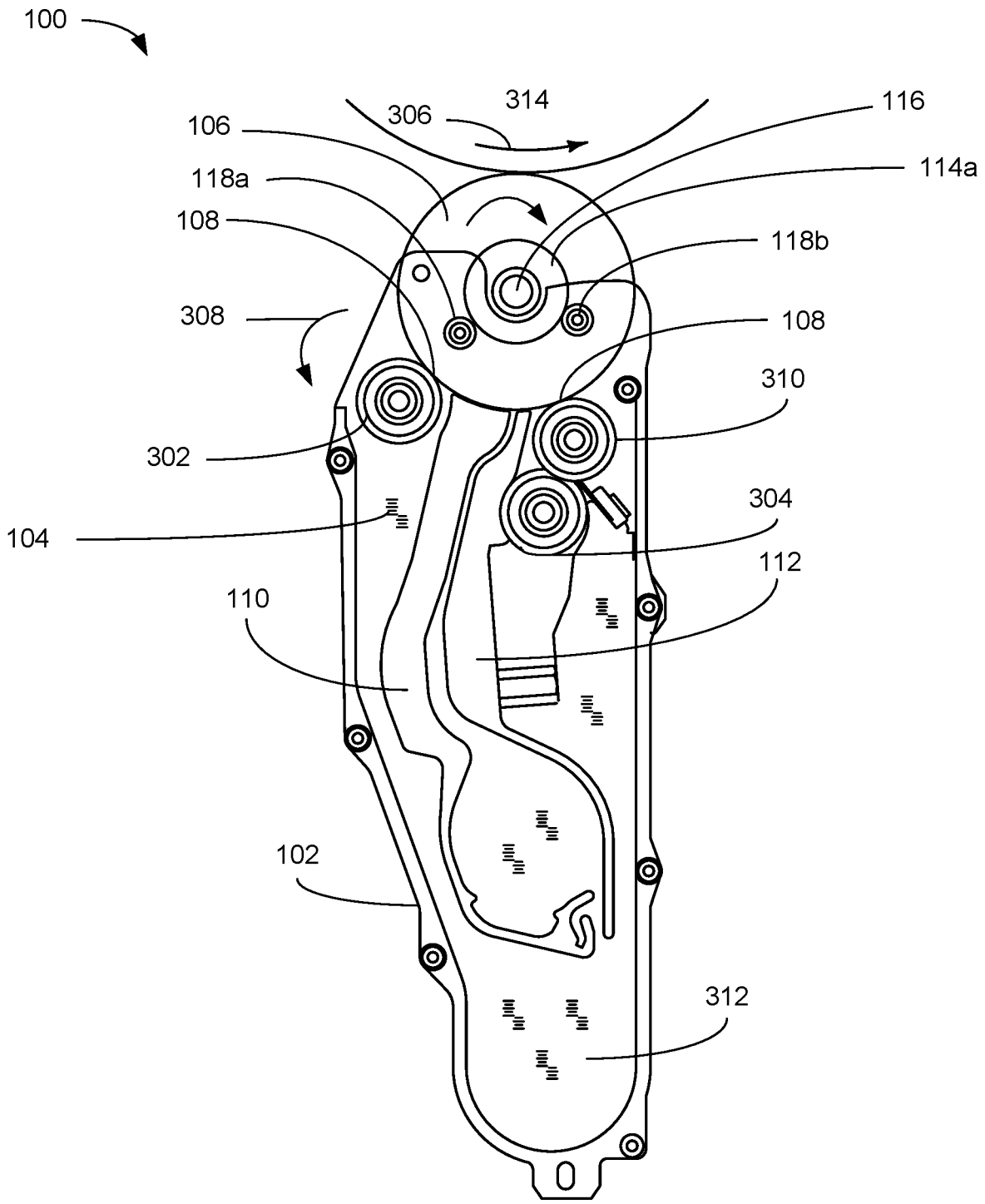
FIG. 3 illustrates a sectional view of the developer system of FIG. 2A.

FIG. 2A illustrates a partially exploded view of a developer system for a LEP printer that includes stop pins for establishing distances between developer roller surfaces and electrodes. A developer system 100 for use in a LEP printer includes a housing 102 with two end caps (first end cap 202 is illustrated at FIG. 2A, with the second end cap opposite the first end cap 202 not being visible in FIG. 2A). A developer roller 106 is rotatably connected to a housing 102. Developer roller 106 includes a developer roller surface 108 for application of print agent to a PIP. Developer roller 106 includes a set of bearings 114*a* and 114*b* to support and enable rotation of an axle 116 attached to the developer roller FIG. 2B illustrates a perspective view and FIG. 3 illustrates a sectional view of the developer system of FIG. 2A. Developer system 100 includes a first electrode 110 and a second electrode 112 disposed in housing 102, the first and second electrodes to create an electrical charge to cause transfer of printing fluid to a developer roller surface 108. In this example, each of the first 110 and second 112 electrodes is attached to the first end cap 202, extends through the housing 102, and is likewise attached to the second end cap that is opposite to the first end cap 202 relative to the length 204 of developer roller surface 108. The second end cap is not visible in FIG. 2A, 2B, or 3.

A first set of stop pins, including first stop pin 118*a* and second stop pin 118*b*, is situated within the first endcap 202 and first bearing 114*a* rests on the first set of stop pins. The second set of stop pins, e.g., a third stop pin and a fourth stop pin, is situated within the second endcap (not visible in FIG. 2A, 2B, or 3) and second bearing 114*b* rests on the second set of stop pins.

In an example, the positioning and/or size of the first set of stop pins 118*a* 188*b* and of the second set of stop pins collectively establishes a first target distance (see 120 FIG. 1) between the developer roller surface 108 and the first electrode 110, and a second target distance (see 122 FIG. 2) between the developer roller surface 108 and the second electrode 112. In a particular example, the first target distance the second target distances are a same target distance, such the gap between the developer roller surface and each of the first and second electrodes is an equivalent gap.

In the example of FIGS. 2A, 2B, and 3 developer system 100 additionally includes a second end cap that is not visible in these figures. In examples, the second end cap may include a second set of stop pins (e.g. a third stop pin and a fourth stop pin) to support second bearing 114*b*. The first and second sets of stop pins each establish a first target distance that is between the first electrode 110 and a developer roller surface 108 and a second target distance that is between the second electrode 112 and the developer roller surface 108.

In certain examples, a print agent capture tray 312 for catching unused print agent is formed near the bottom of the housing 102. Print agent may travel from a print agent reservoir, which may be located outside the developer system 100, between the first and second electrodes 110 112 towards the developer roller 106. The developer roller 106 is to rotate in a first direction 306 shown in FIG. 3. An electric field to be formed between the first 110 and second 112 electrodes and the developer roller 106 is to cause print agent to be attracted to the developer roller surface 108, to thereby form a film or coating of print agent on the developer roller surface 108.

In certain examples, developer system 100 may include, in addition to the developer roller 106, a squeegee roller 302. Squeegee roller 302 is to rotate in a second direction 308 opposite to the first direction of rotation of the developer roller 106, and is to be urged towards the developer roller 106 to compact and remove excess liquid from the print agent that coats developer roller surface 108. An electric charge may be applied, e.g., at the squeegee roller, to create an electric field between developer roller 106 and squeegee roller 302. The electric field is to further cause the print agent to be attracted to the developer roller surface 108, and to compact the print agent film formed thereon. The mechanical and electric forces applied from the squeegee roller 302 to the developer roller surface 108 are to cause the film of print agent on the developer roller surface to be of substantially uniform thickness.

Print agent that is not transferred from the developer roller 106 to the PIP 314 is referred to as unused print agent. In certain examples a cleaner roller 304 is disposed within the developer system 100 adjacent to the developer roller 106, and is to rotate in the second direction 308 opposite to the first direction rotation of the developer roller 106. Cleaner roller 304 is electrically charged and attracts electrically-charged print agent, cleaning unused print agent from the developer roller 106.

In certain examples, developer system 100 may also include a sponge roller 310, which includes an absorbent material, such as an open cell polyurethane foam sponge, mounted around a core. The sponge roller 310 is to rotate in the same direction as cleaner roller 304. In examples, sponge roller 310 is mounted adjacent to cleaner roller 304, such that, as the sponge roller 310 rotates, the absorbent material absorbs the unused print agent from the surface of the cleaner roller. In an example, unused print agent, including print agent caused to be removed from the developer roller by the collective operation of squeegee roller 302, cleaner roller 304, and/or sponge roller 310, may be drained from the print agent capture tray 312 and returned to the print agent reservoir.

Figure 4:
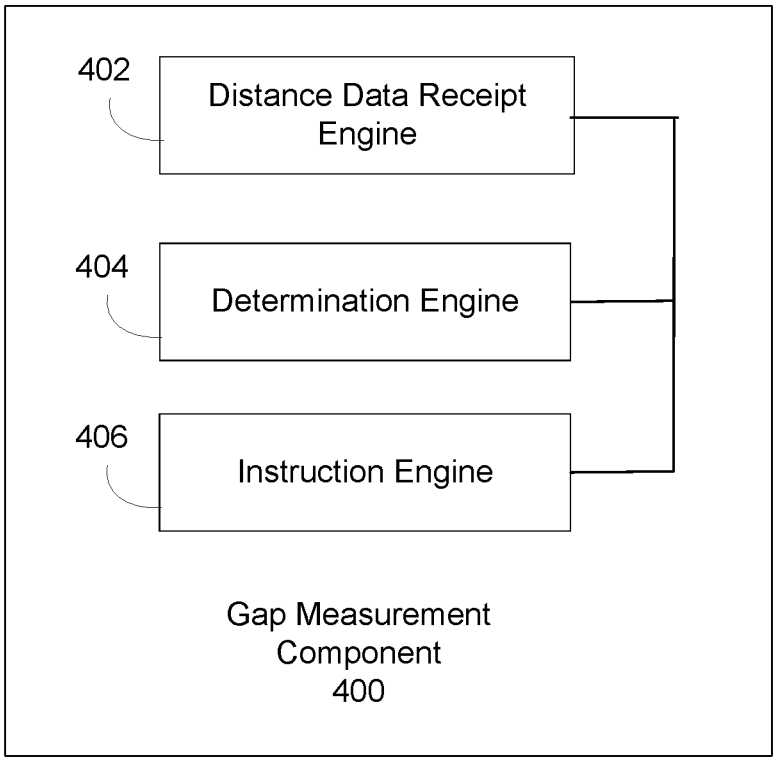
FIG. 4 illustrates an example of a system for establishing distances between developer roller surfaces and electrodes of a developer system.

FIG. 4 depicts examples of physical and logical components for implementing various examples. In FIG. 4 various components are identified as engines 402, 404, and 406. In describing engines 402-406 focus is on each engine's designated function. However, the term engine, as used herein, refers generally to hardware and/or programming to perform a designated function. As is illustrated with respect to FIG. 6, the hardware of each engine, for example, may include one or both of a processor and a memory, while the programming may be code stored on that memory and executable by the processor to perform the designated function.

FIG. 4 illustrates an example of a gap measurement component 400 for establishing distanced between roller surfaces and electrodes in a developer system. In this example, gap measurement component 400 includes a distance data receipt engine 402, a determination engine 404, and an instruction engine 406. In performing their respective functions, engines 402-406 may access a data repository, e.g., a memory accessible to gap measurement component 400 that can be used to store and retrieve data.

In an example, distance data receipt engine 402 represents generally a combination of hardware and programming to receive distance data indicative of a predicted distance between a developer roller surface and a first electrode and a second predicted distance between the developer roller surface and a second electrode. The first and second electrodes are disposed in a housing and are for creating an electrical charge to cause transfer of printing fluid to the developer roller surface during a printing operation. The developer roller surface is a surface of a developer roller rotatably connected to the housing.

Determination engine 404 represents generally a combination of hardware and programming to determine an attribute for each of a plurality of stop pins based upon the first and second predicted distances. In an example where fixed-diameter stop pins are being utilized, the attribute may a diameter or size for a stop pin. In an example where eccentric stop pins are being utilized, the attribute may a predefined position or other setting for an eccentric stop pin. In a particular example, the attribute may be a predefined position according to a mating element (e.g., a mating hole) utilized to adjust diameter of an eccentric stop pin.

In certain examples, gap measurement component 400 may include an instruction engine 406. Instruction engine 406 represents generally a combination of hardware and programming to cause provision of a user instruction as to installing the plurality of stop pins according to the determined attributes. In an example where the user has access to a set of fixed diameter stop pins, the user instruction may be an instruction to select a specific-diameter stop pin from among the set and install such stop pin in the developer system 100 to establish a target distance between a developer roller surface and a first and/or second electrode of the developer system, In an example where the user has access to eccentric stop pins, the user instruction may be an instruction to set an eccentric stop pin to a specified setting, thereby adjusting the diameter of the eccentric stop pin to establish a target distance between a developer roller surface and a first and/or second electrodes of the developer system. In certain examples the user instruction may be communicated via an email or a system message (e.g. a text box, graphic, or other communication associated with an application). In other examples, the user instruction may be communicated via any other type of visual, auditory, or tactile communication.

Figure 5:
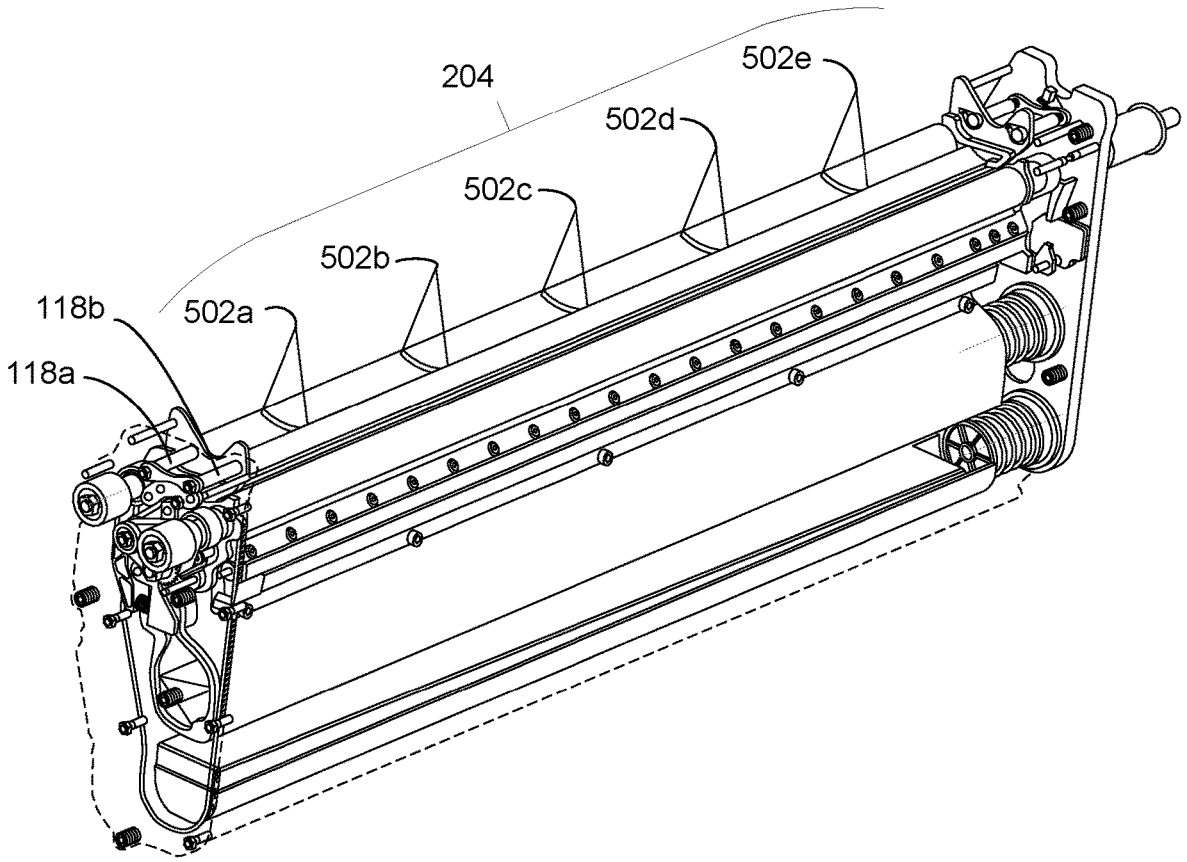
FIG. 5 illustrates an example of generation of distance date indicative of a predicted distance data between developer roller surfaces and an electrode of the developer system of the LEP printer.

Moving to FIG. 5, In certain examples distance data receipt engine 402 may receive predicted distance data indicative of a number 502*a* 502*b* 502*c* 502*d* of predicted distances between an electrode (e.g., first electrode 110 FIG. 3 and second electrode 112 FIG. 3) and a predicted length 204 for the developer roller surface. In such examples, determination engine 404 may in turn determine the attribute for each of the plurality of stop pins based upon the plurality of predicted distances.

In a particular example, the predicted distance data received by distance data receipt engine 402 may be data generated utilizing a measuring device manufactured to a specification such that the measuring device can be temporarily installed at the developer system 100 such that the measuring device rests on end caps (e.g., upon the stop pins mounted to the end caps) in the same manner that the developer roller would rest on the end caps after assembly. In examples, the measuring device has circumference dimensions that are substantially the same as the development roller to be installed, and the measuring device is inserted into a position to be later occupied by the development roller. In certain examples the measuring device may be a laser measuring device with multiple lasers to measure distances between the developer roller surface 108 and the first and second electrodes.

In the foregoing discussion of FIG. 4, engines 402-406 were described as combinations of hardware and programming. Engines 402-406 may be implemented in a number of fashions. Looking at FIG. 6 the programming may be processor executable instructions stored on a tangible memory resource 630 and the hardware may include a processing resource 640 for executing those instructions. Thus, memory resource 630 can be said to store program instructions that when executed by processing resource 640 implement system 100 and gap measurement component 400 of FIGS. 1-4.

Memory resource 630 represents generally any number of memory components capable of storing instructions that can be executed by processing resource 640. Memory resource 630 is non-transitory in the sense that it does not encompass a transitory signal but instead is made up of a memory component or memory components to store the relevant instructions. Memory resource 630 may be implemented in a single device or distributed across devices. Likewise, processing resource 640 represents any number of processors capable of executing instructions stored by memory resource 630. Processing resource 640 may be integrated in a single device or distributed across devices. Further, memory resource 630 may be fully or partially integrated in the same device as processing resource 640, or it may be separate but accessible to that device and processing resource 640.

In one example, the program instructions can be part of an installation package that when installed can be executed by processing resource 640 to implement system 100 and gap measurement component 400. In this case, memory resource 630 may be a portable medium such as a CD, DVD, or flash drive or a memory maintained by a server from which the installation package can be downloaded and installed. In another example, the program instructions may be part of an application or applications already installed. Here, memory resource 630 can include integrated memory such as a hard drive, solid state drive, or the like.

Figure 6:
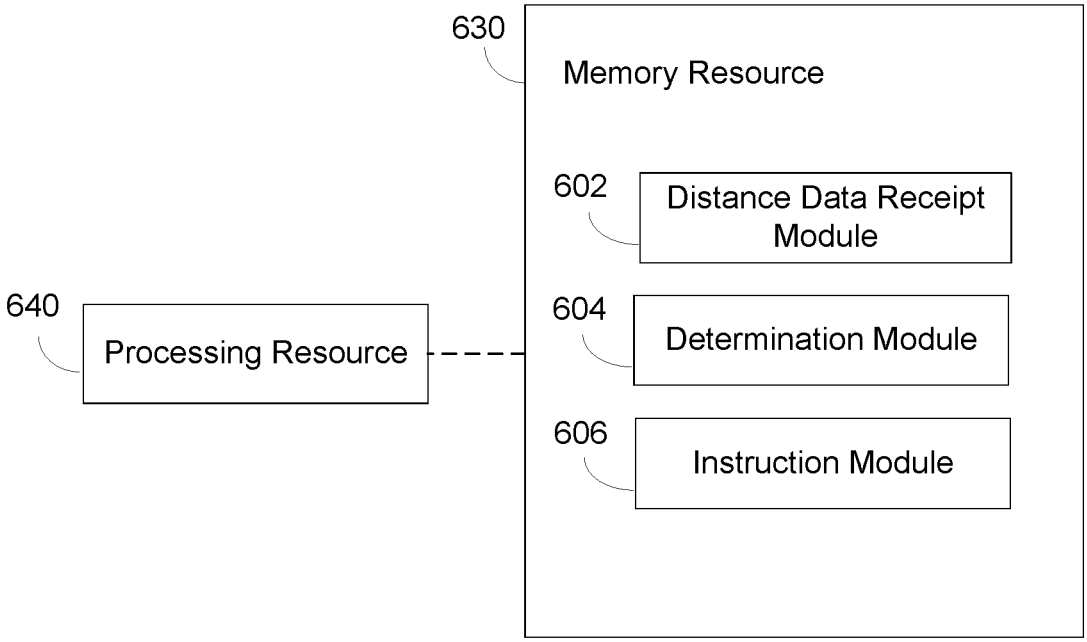
FIG. 6 is a block diagram depicting a memory resource and a processing resource to implement an example of establishing distances between developer roller surfaces and electrodes of a developer system.

In FIG. 6, the executable program instructions stored in memory resource 630 are depicted as distance data receipt engine module 602, determination module 604, and instruction module 606. Distance data receipt engine module 602 represents program instructions that when executed by processing resource 640 may perform any of the functionalities described above in relation to distance data receipt engine 402 of FIG. 4. Determination module 604 represents program instructions that when executed by processing resource 640 may perform any of the functionalities described above in relation to determination engine 404 of FIG. 4. Instruction module 606 represents program instructions that when executed by processing resource 640 may perform any of the functionalities described above in relation to instruction engine 406 of FIG. 4.

Figure 7:
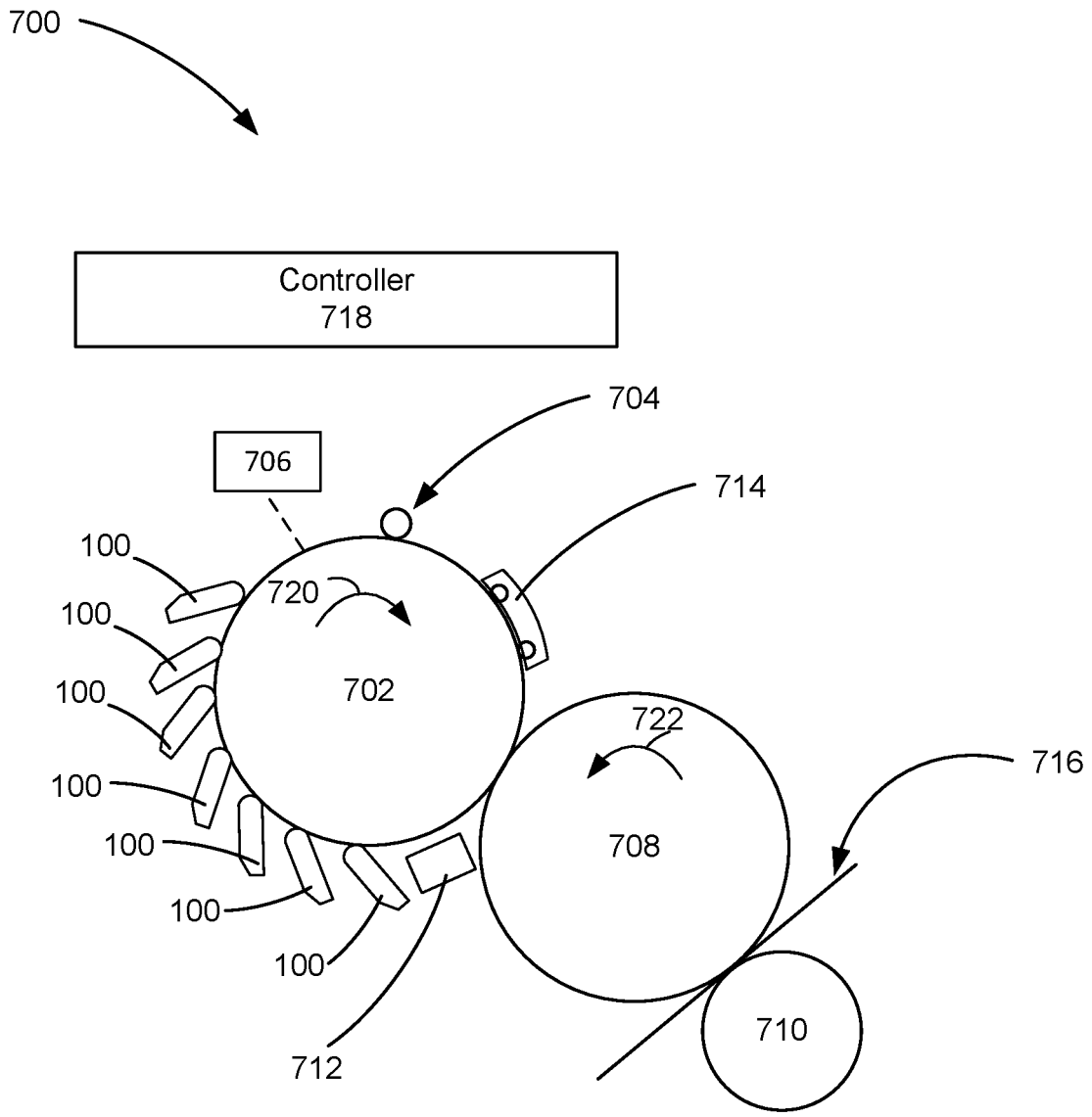
FIG. 7 is a schematic diagram showing a cross section of an example LEP printer implementing the developer systems that include stop pins for establishing distances between developer roller surfaces and electrodes.

FIG. 7 is a diagram of an LEP printer 700 implementing a plurality of developer systems 100 of FIG. 4, according to an example of the principles described herein. In a particular example, each of the developer systems 100 may include a set of stop pins for establishing distances between electrodes and developer roller surfaces of the respective developer system. Along with the other elements previously described in connection with the developer systems 100, the LEP printer 700 may further include a PIP 702, a charging element 704, an imaging unit 706, a blanket 708, an impression cylinder 710, a discharging element 712, and a cleaning station 714.

According to the example of FIG. 7, a pattern of electrostatic charge is formed on a PIP 702 by rotating a clean, bare segment of the PIP 702 under a charging element 704. The PIP 702 in this example is cylindrical in shape, e.g. is constructed in the form of a drum, and rotates in a direction of arrow 720. In other examples, a PIP may planar or part of a belt-driven system.

Charging element 704 may include a charging device, such as corona wire, a charge roller, scorotron, or any other charging device. A uniform static charge is deposited on the PIP 702 by the charging element 704. As the PIP 702 continues to rotate, it passes an imaging unit 706 where one or more laser beams dissipate localized charge in selected portions of the PIP 702 to leave an invisible electrostatic charge pattern ("latent image") that corresponds to the image to be printed. In some examples, the charging element 704 applies a negative charge to the surface of the PIP 702. In other implementations, the charge is a positive charge. The imaging unit 706 then selectively discharges portions of the PIP 702, resulting in local neutralized regions on the PIP 702.

Continuing with the example of FIG. 7, the developer systems 100 are disposed adjacent to the PIP 702 and may correspond to various print agent colors such as cyan, magenta, yellow, black, and the like. There may be one developer system 100 for each print agent color. In other examples, e.g., black and white printing, a single developer system 100 may be included in LEP printer 700. During printing, the appropriate developer system 100 is engaged with the PIP 702. The engaged developer system 100 presents a uniform film of print agent to the PIP 702. The print agent contains electrically-charged pigment particles which are attracted to the opposing charges on the image areas of the PIP 702. As a result, the PIP 702 has a developed image on its surface, i.e. a pattern of liquid toner corresponding with the electrostatic charge pattern (also sometimes referred to as a "separation").

The print agent may be a liquid toner, comprising ink particles and a carrier liquid. The carrier liquid may be an imaging oil. The ink particles may be electrically charged such that they move when subjected to an electric field. Typically, the ink particles are charged such that they are repelled from the similarly charged portions of PIP 702, and are attracted to the discharged portions of the PIP 702.

The print agent is transferred from the PIP 702 to an intermediate transfer member blanket 708. The blanket may be in the form of a rotatable drum, belt or other transfer system. In a particular example, the PIP 702 and blanket 708 are drums that rotate relative to one another, such that the color separations are transferred during the relative rotation. In the example of FIG. 7, the blanket 708 rotates in the direction of arrow 722. The transfer of a developed image from the PIP 702 to the blanket 708 may be known as the "first transfer", which takes place at a point of engagement between the PIP 702 and the blanket 708.

Once the layer of liquid toner has been transferred to the blanket 708, it is next transferred to a print substrate 716. This transfer from the blanket 708 to the print substrate may be deemed the "second transfer", which takes place at a point of engage between the blanket 708 and the print substrate 716. The impression cylinder 710 can both mechanically compress the print substrate 716 in to contact with the blanket 708 and also help feed the print substrate 716. In examples, the print substrate 716 may be a conductive or a non-conductive print substrate, including, but not limited to, paper, cardboard, sheets of metal, metal-coated paper, or metal-coated cardboard.

Controller 718, discussed in more detail below, controls part, or all, of the print process. In examples, the controller 718 can control the voltage level applied by a voltage source, e.g., a power supply, to one or more of the imaging unit 706, the blanket 708, a drying unit, and other components of LEP printer 700.

Figure 8:
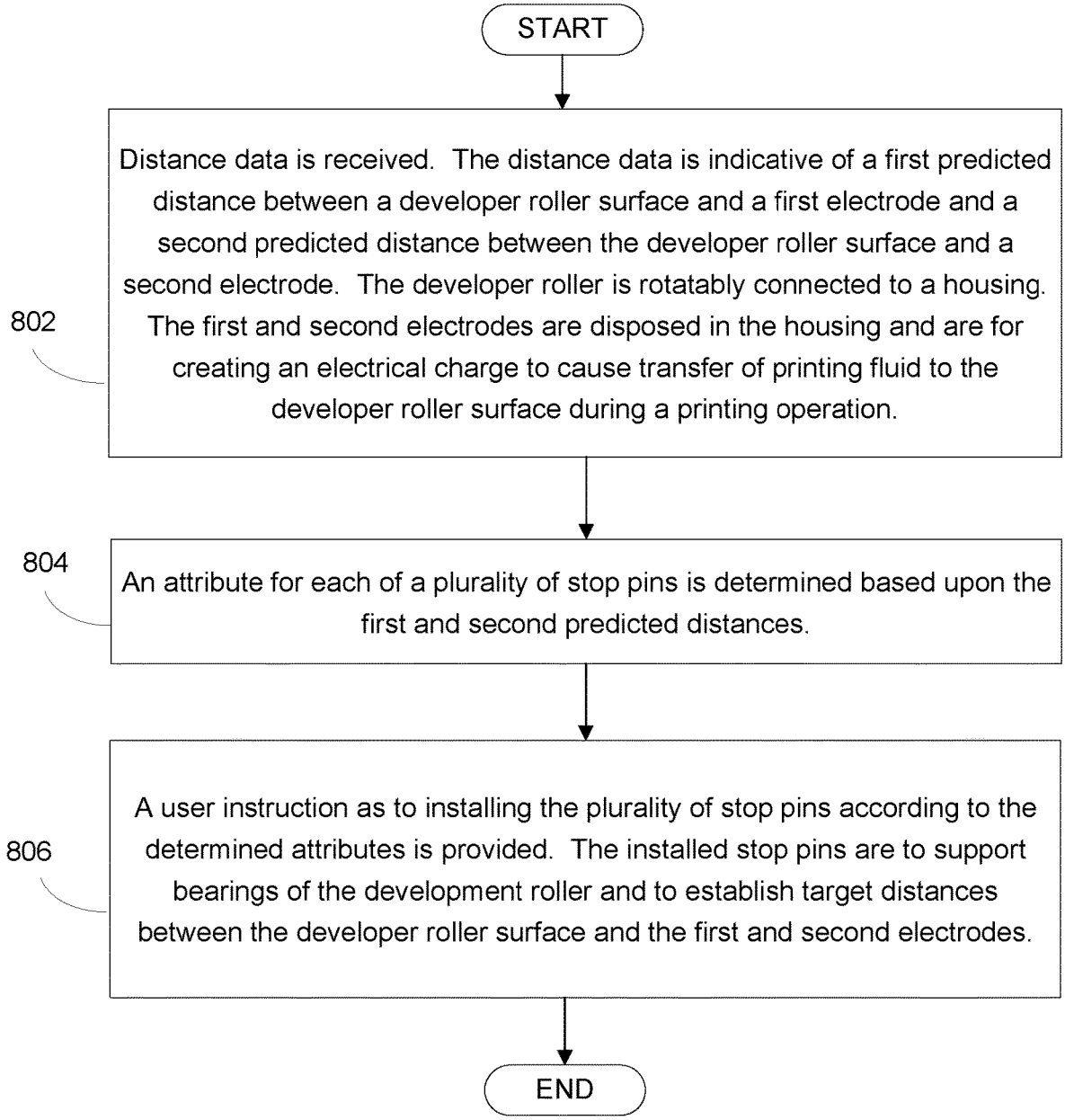
FIG. 8 is a flow diagram depicting implementation of an example of a method for establishing distances between developer roller surfaces and electrodes of a developer system.

FIG. 8 is a flow diagram of implementation of a method for establishing distances between developer roller surfaces and electrodes. In discussing FIG. 8, reference may be made to the components depicted in FIGS. 1-7. Such reference is made to provide contextual examples and not to limit the way the method depicted by FIG. 8 may be implemented. Distance data is received. The distance data is indicative of a first predicted distance between a developer roller surface and a first electrode and a second predicted distance between the developer roller surface and a second electrode. The developer roller is rotatably connected to a housing. The first and second electrodes are disposed in the housing and are for creating an electrical charge to cause transfer of printing fluid to the developer roller surface during a printing operation (block 802). Referring back to FIGS. 1-7, distance data receipt engine 402 (FIG. 4) or distance data receipt module 602 (FIG. 6), when executed by processing resource 640, may be responsible for implementing block 802.

An attribute for each of a plurality of stop pins is determined based upon the first and second predicted distances (block 804). Referring back to FIGS. 1-7, determination engine 404 (FIG. 4) or determination module 604 (FIG. 6), when executed by processing resource 640, may be responsible for implementing block 804.

A user instruction as to installing the plurality of stop pins according to the determined attributes is provided. The installed stop pins are to support bearings of the development roller and to establish target distances between the developer roller surface and the first and second electrodes (block 806). Referring back to FIGS. 1-7, instruction engine 406 (FIG. 4) or instruction module 606 (FIG. 6), when executed by processing resource 640, may be responsible for implementing block 806.

FIGS. 1-8 aid in depicting the architecture, functionality, and operation of various examples. In particular, FIGS. 1-7 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 8 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A developer system for use in a printer, comprising:

a housing;

a first electrode and a second electrode disposed in the housing, the first and second electrodes to create an electrical charge to cause transfer of printing fluid to a developer roller surface;

a developer roller rotatably connected to the housing, the developer roller including the developer roller surface;

a bearing to support and enable rotation of an axle attached to the developer roller;

a plurality of stop pins connected to the housing, the plurality of stop pins to support the bearing:

to establish a first target distance between the developer roller surface and the first electrode and a second target distance between the developer roller surface and the second electrode; and including an eccentric stop pin that is rotatable to a plurality of predefined positions.

2. The developer system of claim 1, wherein the first target distance and the second target distance are a same distance.

3. The developer system of claim 1, wherein the bearing is a first bearing and further comprising a second bearing; and wherein the plurality of stop pins includes a first set of stop pins to support the first bearing and a second set of stop pins to support the second bearing.

4. The developer system of claim 3, wherein the housing includes a first end cap and a second end cap, and wherein each of the first and second electrodes is attached to the first end cap, extends through the housing, and is attached to the second end cap;

the first set of stop pins are situated within the first endcap and the first bearing rests on the first set of stop pins; and the second set of stop pins are situated within the second endcap and the second bearing rests on the second set of stop pins.

5. The developer system of claim 1, wherein the eccentric stop pin is rotatable to the plurality of predefined positions according to mating elements in the first end cap.

6. The developer system of claim 1, wherein first set of stop pins includes a replaceable stop pin.

7. The developer system of claim 1, further comprising a gap measurement component to:

receive predicted distance data indicative of a predicted distance between the developer roller surface and the first electrode and a second predicted distance between the developer roller surface and the second electrode; and determine an attribute for each of the plurality of stop pins based upon the first and second predicted distances.

8. The developer system of claim 7, wherein the gap measurement component is to cause provision of a user instruction as to installing the plurality of stop pins according to the determined attributes.

9. The developer system of claim 7, wherein the gap measurement component is to receive predicted distance data indicative of a plurality of predicted distances between the developer roller surface and each of the first electrode and second electrode along the length of the developer roller surface, and is to determine the attribute for each of the plurality of stop pins based upon the plurality of predicted distances.

10. A method of manufacturing a system for use in a printer, comprising:

receiving distance data indicative of a first predicted distance between a developer roller surface and a first electrode and a second predicted distance between the developer roller surface and a second electrode;

wherein the first and second electrodes are disposed in a housing and are for creating an electrical charge to cause transfer of printing fluid to the developer roller surface during a printing operation;

wherein the developer roller surface is a surface of a developer roller rotatably connected to the housing; and determining an attribute for each of a plurality of stop pins based upon the first and second predicted distances; and providing a user instruction as to installing the plurality of stop pins according to the determined attributes, the installed stop pins to support bearings of the development roller and to establish target distances between the developer roller surface and the first and second electrodes.

11. The method of claim 10, wherein determining an attribute for each of the plurality of stop pins includes determining a diameter for each of the stop pins.

12. The method of claim 10, wherein the received distance data was captured utilizing a laser measuring device with circumference dimensions substantially the same as the development roller, the laser measuring device having been inserted into a position to be later occupied by the development roller.

13. A printer, comprising:

a photo imaging plate;

a print agent developer system to apply print agent to the photo imaging plate, the print agent developer system including a housing;

a first electrode and a second electrode disposed in the housing, the first and second electrodes to create an electrical charge to cause transfer of printing fluid to a developer roller surface;

a developer roller rotatably connected to the housing, the developer roller including the developer roller surface;

a plurality of bearings to support and enable rotation of an axle attached to the developer roller; and a plurality of stop pins connected to the housing, the plurality of stop pins to support the bearings;

to establish a first target distance between the developer roller surface and the first electrode and a second target distance between the developer roller surface and the second electrode; and including an eccentric stop pin that is rotatable to a plurality of predefined positions.

* * * * *